US006116325A

United States Patent [19]

Colson et al.

[11] Patent Number: 6,116,325

[45] Date of Patent: Sep. 12, 2000

[54] BREAK AWAY OPERATING CORD SYSTEM FOR RETRACTABLE COVERINGS FOR ARCHITECTURAL OPENINGS

[75] Inventors: Wendell B. Colson, Weston, Mass.; Marek Jarosinski, Brighton, Colo.

[73] Assignee: Hunter Douglas Inc., Upper Saddle River, N.J.

[21] Appl. No.: 09/050,507

[22] Filed: Mar. 30, 1998

Related U.S. Application Data

[60] Provisional application No. 60/041,791, Apr. 2, 1997.

[51] Int. Cl.[7] ..... A47G 5/02

[52] U.S. Cl. ..... 160/321; 160/178.1 R; 74/89.22; 474/139

[58] Field of Search ..... 160/321, 292, 160/307, 308, 170 R, 178.1 R; 74/89.22; 474/139; 248/900, 267

[56] References Cited

U.S. PATENT DOCUMENTS

| | | | |
|---|---|---|---|
| 936,387 | 10/1909 | Tripp | 160/321 |
| 1,691,463 | 11/1928 | Brewer | 160/321 |
| 1,806,228 | 5/1931 | Ward . | |
| 2,165,492 | 7/1939 | Lorentzen . | |
| 2,183,289 | 12/1939 | Haase . | |
| 3,595,511 | 7/1971 | Summerville, Jr. | 248/267 |
| 4,372,432 | 2/1983 | Waine et al. | 160/321 |
| 4,909,298 | 3/1990 | Langhart et al. . | |
| 5,092,389 | 3/1992 | Tedeschi | 160/321 |
| 5,313,999 | 5/1994 | Colson et al. . | |
| 5,361,822 | 11/1994 | Nijs . | |
| 5,375,643 | 12/1994 | Rude | 160/321 |
| 5,485,875 | 1/1996 | Genova . | |
| 5,518,057 | 5/1996 | Huang . | |
| 5,577,543 | 11/1996 | Jelic . | |
| 5,791,393 | 8/1998 | Judkins | 160/321 |

FOREIGN PATENT DOCUMENTS

| | | | |
|---|---|---|---|
| 7661 | 4/1893 | United Kingdom | 160/321 |

*Primary Examiner*—Blair M. Johnson
*Attorney, Agent, or Firm*—Dorsey & Whitney LLP

[57] ABSTRACT

A break away operating cord system for retractable coverings for architectural openings such as windows, doors, arches or the like includes a mounting plate to which an operating cord is attached and wherein the mounting plate is releasable from the remainder of the control system for the retractable covering allowing the operating cord to be separated from most of the covering to avoid injury to a child or infant whose head might be trapped within the closed operating cord loop.

43 Claims, 6 Drawing Sheets

25
130
98
90
92
94
40
96
106
42
118
14
80
38
82
76
78
114
116
126
124
112
128
122
110
120
30
60
134
74
56
70
58
72
64
68
46
66
64"
48
36
50
64'
44
108
34
142
144
140
138

BREAK AWAY OPERATING CORD SYSTEM FOR RETRACTABLE COVERINGS FOR ARCHITECTURAL OPENINGS

CROSS-REFERENCE TO RELATED APPLICATION

This application is a non-provisional application corresponding to U.S. provisional application Ser. No. 60/041,791 filed Apr. 2, 1997.

BACKGROUND OF THE INVENTION

1. Field of the Invention

The present invention relates generally to retractable coverings for architectural openings and, more particularly, to safety operating cord systems for such a covering.

2. Description of the Relevant Art

Retractable coverings for various architectural opening such as windows, doorways, archways, and the like typically include a retractable barrier which might be a drapery, mini-blind, vertical blind or the like. Such retractable window coverings are typically operated with at least one pull cord system. The operating cord system can be used to extend or retract the covering across the architectural opening or to manipulate vanes utilized in the covering into various positions when the covering is extended. In either event, a pair of cords or a closed loop cord typically depend from one end of the covering for hand manipulation by an operator.

When the pull cord has two free ends, they are many times interconnected to form a closed loop to facilitate operation of the covering. Endless cords are also utilized. The closed loop or endless cords pose an inherent danger to young children and infants in that should the head of the child or infant become entangled in the operating cord, the child or infant can be inadvertently hung or otherwise badly injured.

To resolve the inherent danger presented by operating cords that have their ends interconnected to establish an endless loop, safety systems have been devised. For example, where two free ends of a operating cord are interconnected with a connector, some connectors have been designed to separate or disengage the connection of the free ends of the cord upon a particular force being applied to the cords. An example of such a system is shown in U.S. Pat. No. 5,518,057 issued May 21, 1996. The system disclosed in the patent utilizes a cap in which one end of the operating cord can be securely fixed and in which the opposite end of the operating cord can be releasably fixed such that when a separating force is provided between the two operating cords in effect increasing the separation between the cords, the releasable end of the operating cord is allowed to pass through an enlarged slot in the cap so that it is released from the cap thereby allowing the two cords to be separated so that even if a child or infant's head were caught between the two depending portions of the operating cord, it would not cause injury as the effective endless nature of the cord would have been eliminated.

Another example of a safety system is disclosed in U.S. Pat. No. 4,909,298 issued Mar. 20, 1990. In this system the connector at the free ends of an operating cord is designed to separate into two parts upon predetermined forces applied thereto such that each cord end remains connected to one part of the connector but the operating cord is thereby separated to avoid injury to a child whose head may have been caught in the cord.

It is also well known in the field of retractable coverings for architectural openings to provide clutch systems between the operating cords and tilt rods, control rods or roll bars used in the operation of the covering so that the tilt rod or the like can only be rotated under desired conditions. In a typical system, the operating cord is operatively engaged with a drive wheel which is coupled to the tilt rod with the clutch system so that neither the drive wheel nor the tilt rod will rotate unless an axial pulling force is applied to one depending portion of the operating cord or another. Such an arrangement, for example, prevents a window shade from coming unrolled due to the weight of the shade unless their is a desired manipulation of the operating cord.

Current art is devoid of a reliable system for preventing the above described injury to children or infants inasmuch as prior art systems are dependent upon a particular separating force being applied between the two depending portions of the operating cord, but if the operating cord is twisted, knotted or the like, the force may not release the operating cord from the connector and resultant injury to the child may occur.

To date, almost all of the attention directed to childproofing operating cords has been focused on the connector at the lower free end of the operating cord, but as mentioned previously, certain limitations are presented when trying to resolve the problem by focusing on the free ends of the cord and their interconnection with each other.

It is to overcome the shortcomings in the prior art and to provide a new and improved system for releasing a operating cord from its operative connection with the control mechanism of an architectural covering that the present invention has been developed.

SUMMARY OF THE INVENTION

The present invention relates to a system for childproofing the operating cord system on retractable coverings for architectural openings wherein the entire cord is designed to break away from the control system for the covering under pre-selected conditions. The system has also been uniquely designed so that should its user desire, the break away feature can be deactivated.

The break away operating cord system of the present invention is designed for use at the control end of the headrail of a retractable covering where a control rod, tilt rod, roll bar or the like that extends horizontally across the top of the covering is rotatably manipulated. The roll bar or the like is operatively engaged with a drive wheel about which the operating cord extends in frictional engagement therewith so that the application of an axial pulling force to either depending portions of the operating cord causes rotation of the drive wheel and thus the roll bar. A clutch system is also incorporated into the control system and prevents rotation of the roll bar unless an axial pulling force is applied to only one depending portion of the operating cord or the other but the roll bar will not rotate if two axial pulling forces of substantially the same degree are simultaneously applied to the two depending portions of the operating cord or if there are no forces being applied, so that the roll bar remains locked in a static state unless it is desired to rotate the same.

For purposes of the present disclosure, the operating cord will be defined as an endless cord including first and second depending portions, with these portions referring to the portions of the operating cord which depend from opposite sides of the drive wheel. In other words, the operating cord in its operative engagement with the drive wheel depends from the wheel in two separate portions such that an axial pulling force applied to one portion will rotate the drive wheel in one direction, while an axial pulling force applied to the other portion will rotate the drive wheel in the opposite direction. As mentioned previously, if an axial pulling force of substantially the same degree is simultaneously applied to both portions of the cord, the drive wheel will not rotate nor will the drive wheel rotate if no force is applied to any portion of the operating cord as the clutch system operates as a brake to prevent rotation except under the predesignated conditions of an axial pulling force being applied to one or the other of the cord portions.

The operating cord in accordance with the present invention is slidably attached to a mounting plate which in turn is releasably mounted on a mounting support. The mounting plate is releasably connected to the mounting support by a system that permits the mounting plate to be released from the mounting support if substantially equal simultaneous axial pulling forces are applied to both cord portions such as when the weight of a child or infant is applied to the operating cord from between the two cord portions (i.e., the infant's neck is caught in the bottom of the cord loop). Alternatively, if only one of the cord portions is being pulled at any one time, the mounting plate will remain secured to the mounting support. In this manner, the retractable covering can be desirably operated to reversibly rotate the drive wheel and consequently the roll bar or the like, but under the unusual circumstance where both cord portions are pulled at the same time, the mounting plate is released from the mounting support thereby disengaging the operating cord from the control system such that injury can be avoided to a child or infant whose head may become entangled in the operating cord portions.

Other aspects, features and details of the present invention can be more completely understood by reference to the following detailed description of a preferred embodiment, taken in conjunction with the drawings and from the appended claims.

DESCRIPTION OF THE PREFERRED EMBODIMENT

Figure 1:
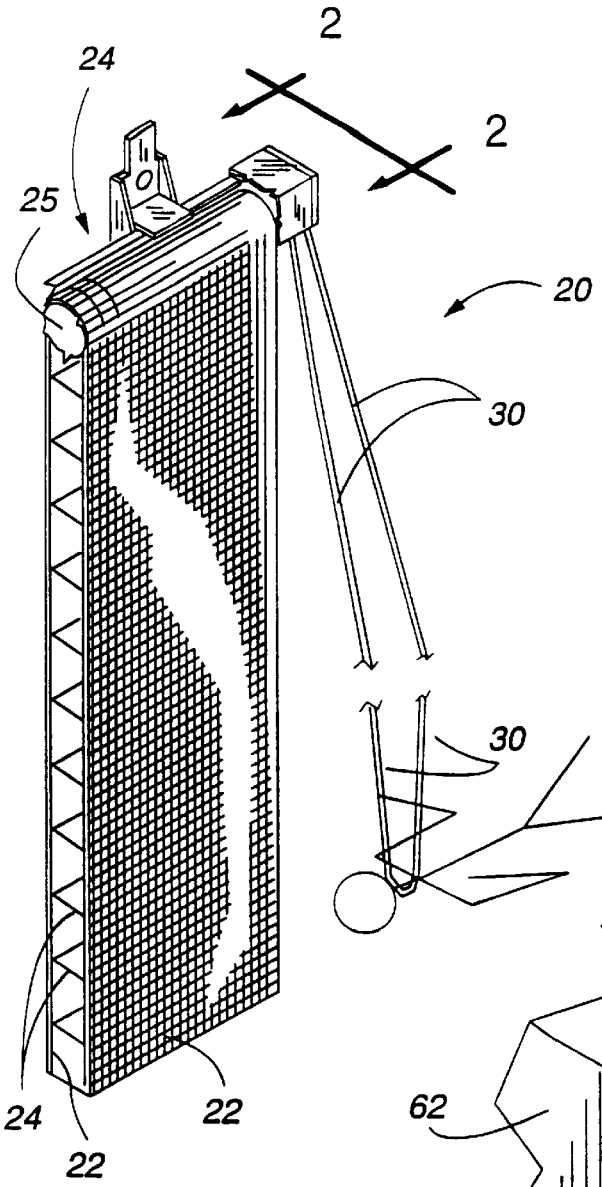
FIG. 1 is a fragmentary isometric view looking at the back side of a vertical vane-type architectural covering utilizing an endless operating cord in its operation and with a stick figure of a child caught in the operating cord shown in phantom lines.

Retractable coverings for architectural openings such as windows, doors, archways and the like take various forms. The present invention will be described in connection with a vertical vane vane covering 20 of the type shown in FIG. 1 and described in more detail in U.S. Pat. No. 5,313,999 issued May 24, 1994 which is commonly owned with the present application. The covering includes a pair of flexible sheets 22 connected at spaced intervals by flexible horizontal vanes 24. The sheets are suspended in a vertical orientation from a control system 24 in a headrail 26 for the covering. It should be appreciated, however, that the present invention would find usefulness in other commonly available coverings.

The control system 24 for the covering shown in FIG. 1 includes a roll bar 25 about which the sheets and vanes are selectively rolled through rotation of the roll bar that is controlled by an operating cord 30. The roll bar may be of the type described in detail in U.S. Application Ser. No. 08/198,317 filed Feb. 18, 1994, which is of common ownership with the present application, and is hereby incorporated by reference.

Figure 2:
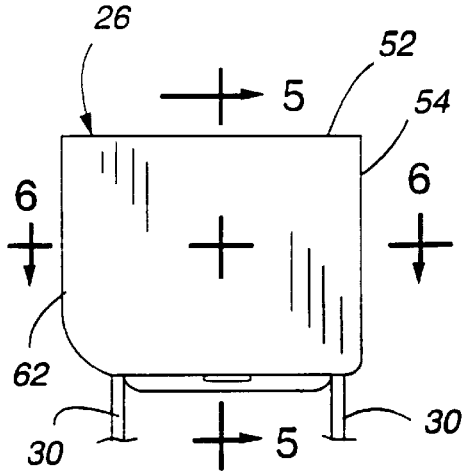
FIG. 2 is an enlarged fragmentary view taken along line 2—2 of FIG. 1.
Figure 3:
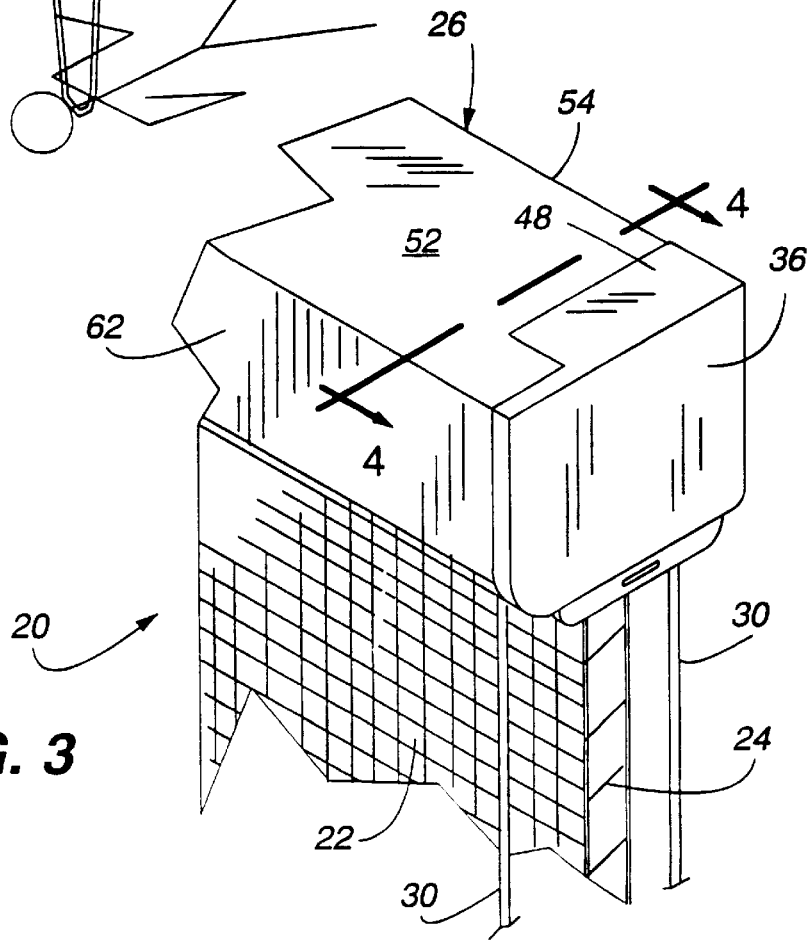
FIG. 3 is a fragmentary isometric view looking at the end of the retractable covering having the operating cord therein.
Figure 4:
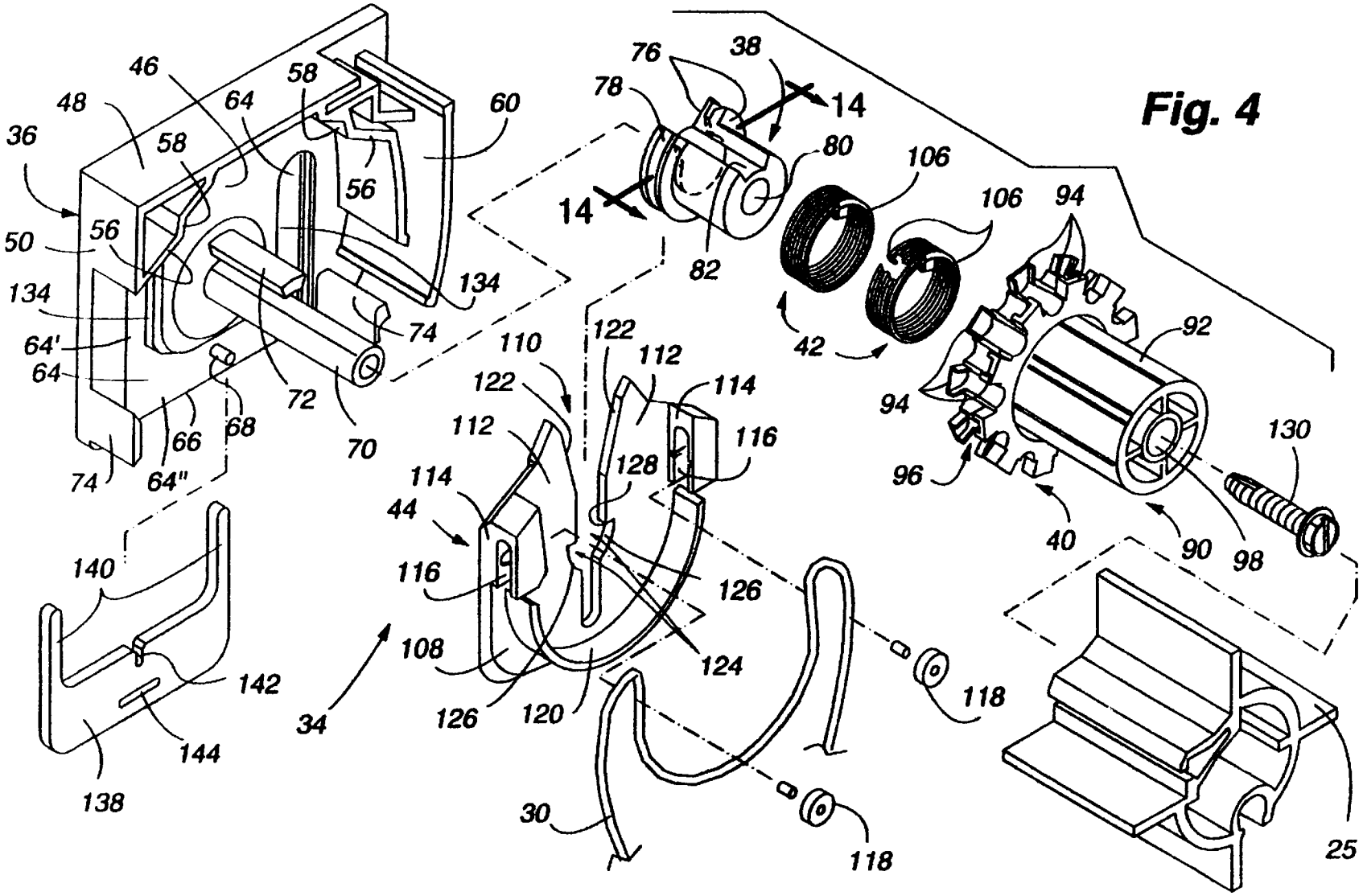
FIG. 4 is an enlarged and exploded isometric view taken along line 4—4 of FIG. 3 but with the roll bar shown in reduced size for convenience.

FIGS. 2 through 4 illustrate the end of a headrail 26 of the architectural covering where the operating cord system 34 of the present invention is incorporated, and it can be appreciated that the system can be fully incorporated into the headrail of the architectural covering for aesthetic purposes.

The operating cord system 34 of the present invention is probably best understood by reference to FIG. 4 where the component parts of the system are shown in exploded relationship. It will there be seen that the operating cord system basically includes an end cap of the headrail 26 referred to hereinafter as the mounting support 36, a mounting hub 38 supported on the mounting support, a drive member 90 having a pair of clutch coil springs 42 disposed therein and mounted on the mounting hub, a releasable mounting plate 44 that is releasably connected to the mounting hub 38 and the endless operating or operating cord 30 supported by the mounting plate for operative engagement with the drive member. A portion of the roll bar 25, which does not form part of the operating cord system is also shown in FIG. 4.

Figure 8:
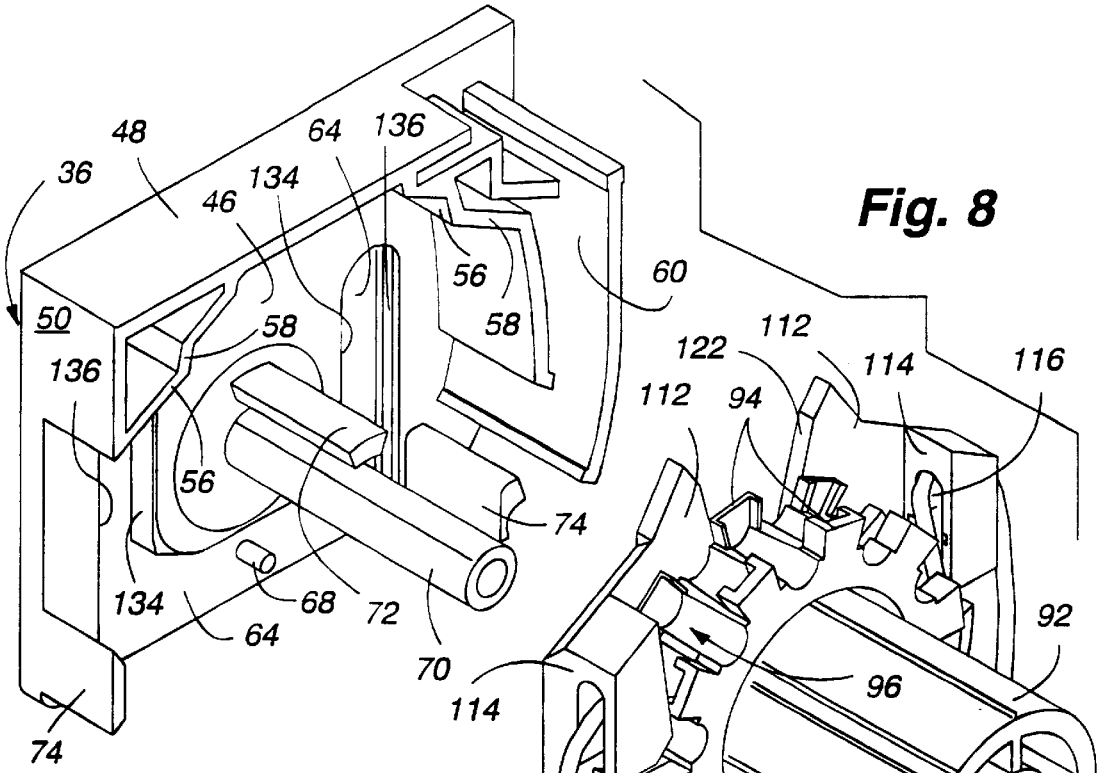
FIG. 8 is a fragmentary enlarged isometric view showing the drive wheel mounted on the mounting plate and separated from the mounting support.

The mounting support 36 can be seen in FIGS. 2 and 3 to constitute the end cap for the headrail 26 of the retractable covering and also the base or support for the working components of the operating cord system 34. The mounting support includes a relatively flat base 46 which forms the end wall of the headrail with several component parts of the mounting support projecting inwardly from the flat base as best seen in FIGS. 4 and 8.

As best seen in FIG. 4, perpendicular projections from the base 46 define a top wall 48 and a side wall 50 which are coplanar with the corresponding top wall 52 and side wall 54 of the headrail 26, as best appreciated in FIG. 3. A pair of zig zag, segmented partitions 56 extend in a downwardly divergent direction from the top wall 48 of the mounting support, with each partition defining an abutment surface 58. An arcuate plate-like projection 60 is also provided along the opposite side from the side wall 50. The arcuate plate-like projection 60 is adapted to fit interiorly of a corresponding arcuate wall 62 of the headrail as best seen in FIGS. 2 or 3. The inner surface of the base 46, from which the projection 60 protrudes has a generally U-shaped broad groove 64 formed therein which covers a substantial portion of the width of the mounting support. The groove has upstanding leg portions 64' and a knee portion 64" opening through and along the bottom edge 66 of the base. A guide pin 68 forms a horizontally centered projection from the base portion 64" groove 64 adjacent to the bottom edge of the base, with the guide pin being in vertical alignment with a support shaft 70 that extends perpendicularly from the base. Immediately above the support shaft 70, a stop arm 72 projects perpendicularly away from the base in spaced parallel relationship with the support shaft. Also projecting perpendicularly from the base 46 adjacent opposite sides of the bottom edge 66 are a pair of cord guide fingers 74 for combining the cord therebetween.

Figure 9A:
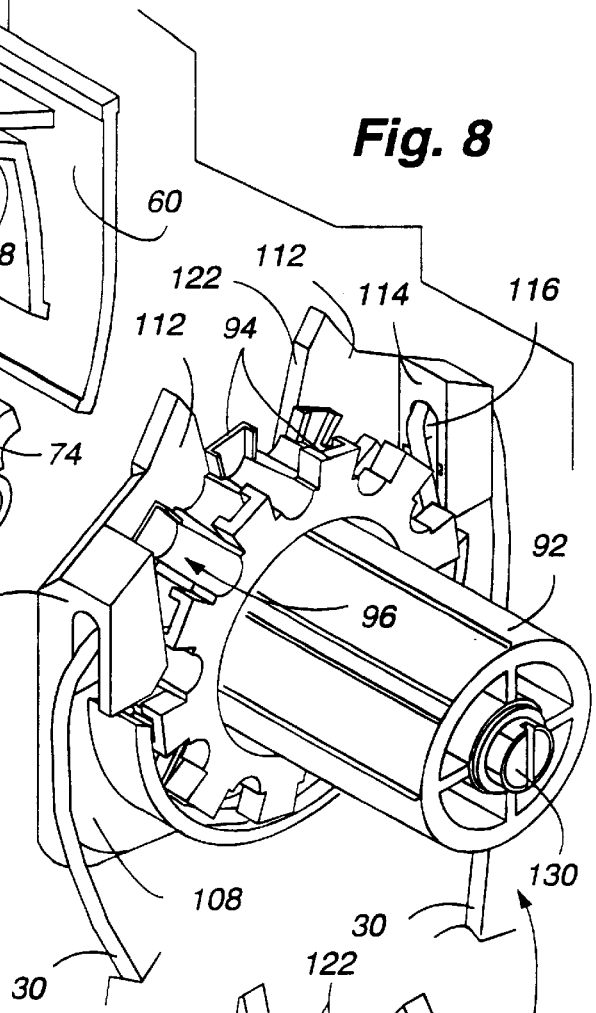
FIG. 9A is an isometric view showing the back side of the mounting plate which is releasably seated upon the central hub and showing the lock plate separated therefrom in solid lines and in a locking position in dashed lines.
Figure 9A:
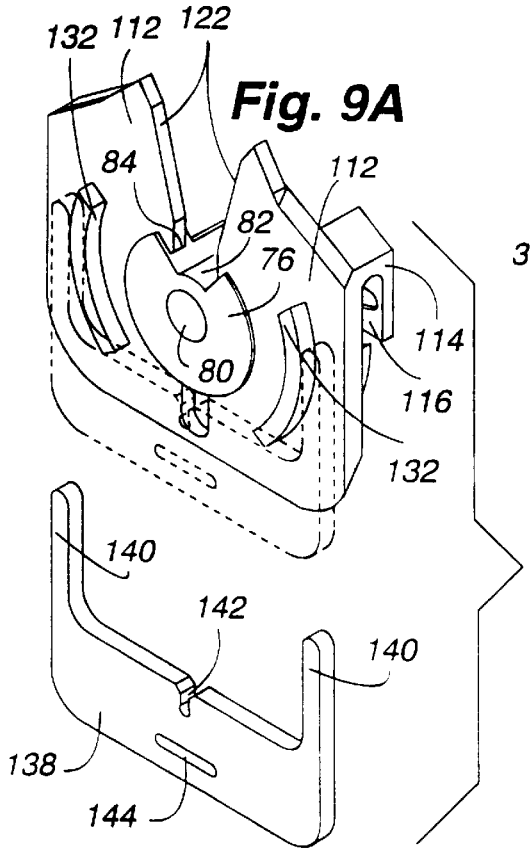
Figure 9B:
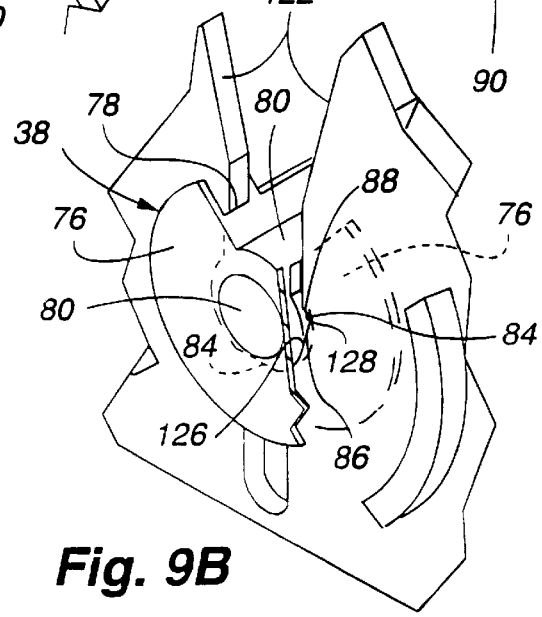
FIG. 9B is an enlarged isometric similar to FIG. 9A with parts broken away for clarity.

The mounting hub 38, as probably best seen in FIGS. 4, 9A, and 9B, is a generally cylindrical body having a pair of spaced enlarged circular discs 76 at one end which define therebetween an annular groove 78. A central cylindrical axial passage 80 extends through the cylindrical main body and a generally U-shaped longitudinally extending channel 82 is formed in the top surface of the cylindrical body. The diameter of the cylindrical passage 80 is slightly greater than the diameter of the support shaft 70 on the mounting support so that the mounting hub can be seated on the support shaft for pivotal movement about its longitudinal axis. When seated on the support shaft, the stop arm 72 of the mounting support lies within the generally U-shaped channel 82. The U-shaped channel is slightly wider than the stop arm 72 for a purpose to be described in more detail hereafter.

Figure 14:
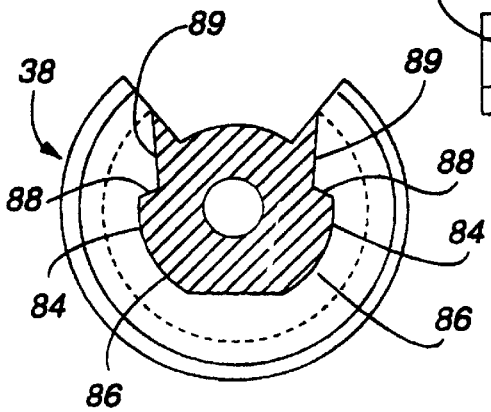
FIG. 14 is an end elevation of the central hub showing the unusual configuration of the inner surface of the annular groove therein.

As best seen in FIGS. 9B and 14, the inner surface 84 of the annular groove of the mounting hub 38 is not circular, as are the circular discs 76, but rather has a semicircular lower half 86 that terminates in substantially horizontal shoulders 88 that are, in turn, continuous with relatively straight vertical walls 89. The purpose of the unique configuration of the inner surface 84 of the annular groove 78 will be apparent with the description that follows. It will be appreciated, however, that when the mounting hub is disposed upon the support shaft 70, it is allowed to pivot about its longitudinal axis within limits substantially defined by the relative widths of the U-shaped channel 82 in the mounting hub and the stop arm 72 on the mounting support which is positioned within the channel 82.

The drive member 90, as best seen in FIG. 4, has a drive wheel 40 and a generally cylindrical main body 92 with the drive wheel integrally formed therewith at one end. The drive wheel has alternate radially extending teeth 94 along side edges thereof which define therebetween a channel 96 in which the operating cord 30 is releasably seated for driving engagement with the drive wheel. As probably best seen in FIGS. 5 and 6, a cylindrical passage 98 extends through the drive member 90 and has a small diameter portion 100 within the cylindrical body and a relatively large diameter portion 102 also within the cylindrical body, but adjacent the end of the body having the drive wheel 40. The large diameter portion 102 with a recess 103 is slightly larger than the outer diameter of the cylindrical body of the mounting hub 38, so that the drive member can be rotatably mounted on the mounting hub.

The pair of clutch coil springs 42 are seated within the recess 103 in the large diameter portion 102 of the cylindrical passage 98 in the drive member 90, even though one such coil spring would also work satisfactorily. Each coil spring has a radially inwardly directed tab or engagement finger 106, as best seen in FIG. 4, at each end of the coil, with the tabs of each spring being circumferentially spaced from each other an arcuate distance slightly greater than the width of the stop arm 72 on the mounting support 36. The outer diameter of the coil springs is substantially equal to the outer diameter of the recess 103 in the large diameter portion 102 of the cylindrical passage 98 in the drive member, while the inner diameter of the coil springs is approximately equal to the inner diameter of the large diameter portion 102 of the passage 98. The coil springs are seated within the recess in the cylindrical passage in the drive member and are adapted to circumscribe the cylindrical body of the mounting hub when the drive member is positioned on the mounting hub. The tabs, or engagement fingers 106, on the coil springs are adapted to be positioned within the U-shaped channel 82 in the mounting hub adjacent to opposite sides of the channel. The cylindrical main body of the drive member defines a support hub for the roll bar 25 (as best seen in FIG. 4) that extends horizontally within the headrail of the retractable covering. The roll bar is operatively secured to the drive member in any suitable direct or indirect manner so as to rotate in unison with the drive member. It should be appreciated that with only minor modification, the drive member could be modified to operatively drive any other rotatable member or element such as a rod, gear, tube or the like, which might be found in coverings for architectural openings.

The coil springs 42 form part of a clutch system for selectively engaging and disengaging the drive member 90 to the mounting hub 38. The mounting hub is, of course, restricted to only minimal pivoting movement by the stop arm 72 of the mounting support being positioned in the U-shaped channel 82. When the clutch system is disengaged, the drive member is fixed to the mounting hub and thereby limited to the same minimal pivotal movement. Engagement of the clutch system, however, allows the drive member to rotate freely in either rotative direction, so as to rotate the tilt rod within the headrail as desired.

The mounting plate or force release mechanism 44, as probably best seen in FIGS. 4, 9A, and 9B, supports the operating cord 30 and is releasably connectable to the mounting hub 38, so as to be released therefrom under prescribed conditions. The mounting plate will also be seen to constitute the operative component for engaging and disengaging the clutch system upon predetermined movement of the operating cord.

The mounting plate includes a base 108 having a generally U-shaped upwardly opening notch 110 formed therein which is defined by a pair of spaced clamp arms 112 that are flexible but resilient. The material from which the base plate 108 is made establishes the resilient and flexible nature of the clamp arms 112 with the material being a suitable plastic, the particulars of which would be well within the knowledge of those skilled in the art. A preferred material would be Delrin®, a product manufactured by DuPont. Adjacent each side of the clamp arms, inwardly directed blocks 114 are formed on the base with downwardly and laterally opening channels 116 therethrough which are adapted to support a pulley 118 around which the operating cord 30 extends. A semi-circular guide plate 120 projects perpendicularly from the inner face of the base 108 of the mounting plate, with the radius of the guide plate 120 being slightly greater than the radius of the drive wheel 40 on the drive member 90. As will be appreciated with the description that follows, the space between the drive wheel and the guide plate 120 defines a confining channel in which the operating cord is disposed when the cord is in operative engagement with the drive wheel.

The generally U-shaped notch 110 formed in the base of the mounting plate 44 has side edges 122 which are generally upwardly and outwardly divergent. An enlarged recess 124 is defined in each side edge of the notch, which has an arcuate segment 126 and a horizontal lip 128. The arcuate segments 126 and horizontal lips 128 conform in size and configuration with the inner surface of the annular groove 78 in the mounting hub 38. Due to the flexible and resilient nature of the clamp arms 112 defined in the base of the mounting plate, the mounting plate can be releasably connected to the mounting hub by moving the mounting plate upwardly so that the clamp arms are received and guided within the annular groove 78. As the clamp arms are moved upwardly, they are forced to flex away from each other by the relatively larger diameter of the inner surface 84 of the annular groove 78 until the enlarged recesses 124 in the edges 122 of the clamp arms become aligned with the semicircular lower half 86 and shoulders 88 on the inner surface 84 of the annular groove 78. When the mounting plate and mounting hub are so aligned, the mounting plate is releasably snapped onto the mounting hub, with the shoulders 88 of the inner surface 84 and the lips 128 on the mounting plate being in abutting engagement so that the mounting plate and mounting hub pivot unitarily. If the clamp arms are yieldingly separated from each other, however, it will be appreciated that the mounting plate 44 can be slid downwardly and released from the mounting hub 38.

Figure 13:
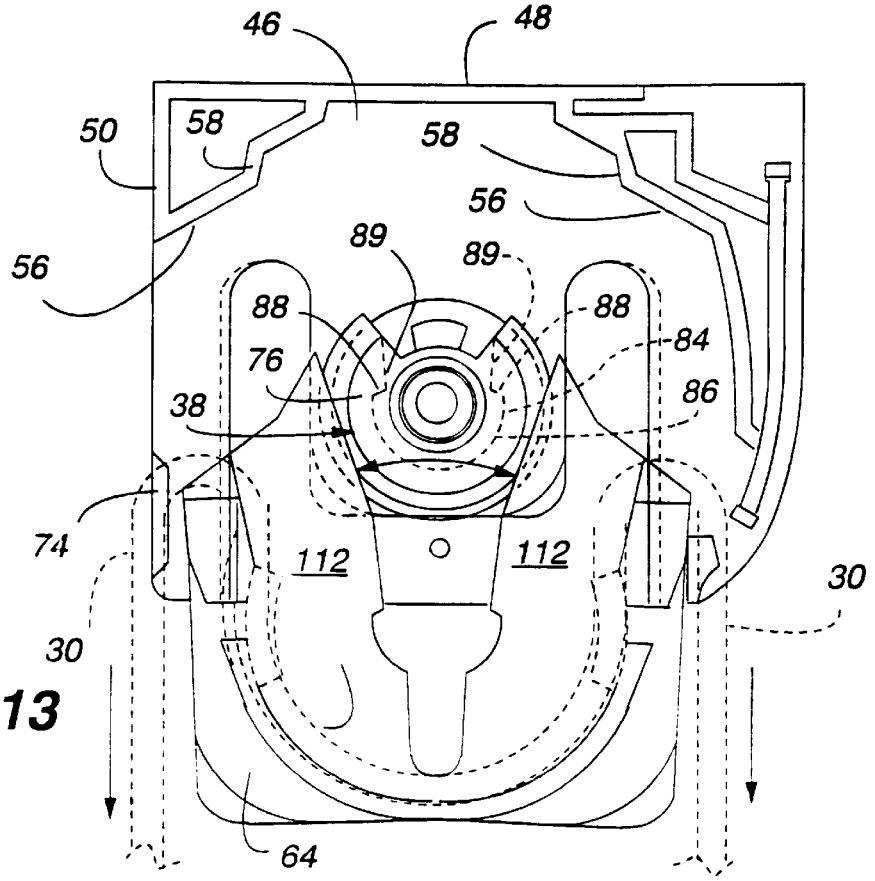
FIG. 13 is a frontal view of the mounting plate being partially separated from the mounting support and the mounting hub which is disposed on the mounting support.

In the assembly of the components of the break away operating cord system 34 of the present invention, the mounting hub 38 is first slid onto the support shaft 70 of the mounting support 36 with the circular discs 76 disposed adjacent to the inner surface of the base 46 of the mounting support. The stop arm 72 of the mounting support is positioned within the U-shaped channel 82 on the top of the mounting hub 38 so that the mounting hub is allowed to pivot slightly about its longitudinal axis. The drive member 90 with the coil springs 104 disposed therein is next advanced onto the cylindrical body of the mounting hub with the tabs or engagement fingers 106 of the coil springs being disposed on opposite sides of the stop arm and within the U-shaped channel, as best seen in FIG. 13. The drive member is secured to the mounting support 36 with a bolt-type fastener 130 having an enlarged head which is threaded into the end of the support shaft 70 with the head of the fastener overlying the end of the drive member 90 to prevent its removal from the support shaft while permitting rotation relative thereto.

As mentioned previously, with the parts assembled as described, when the clutch is disengaged, the drive member 90 is locked by the coil springs to the mounting hub 38 so that the drive member is restricted to limited pivotal movement in unison with the mounting hub.

Figure 5:
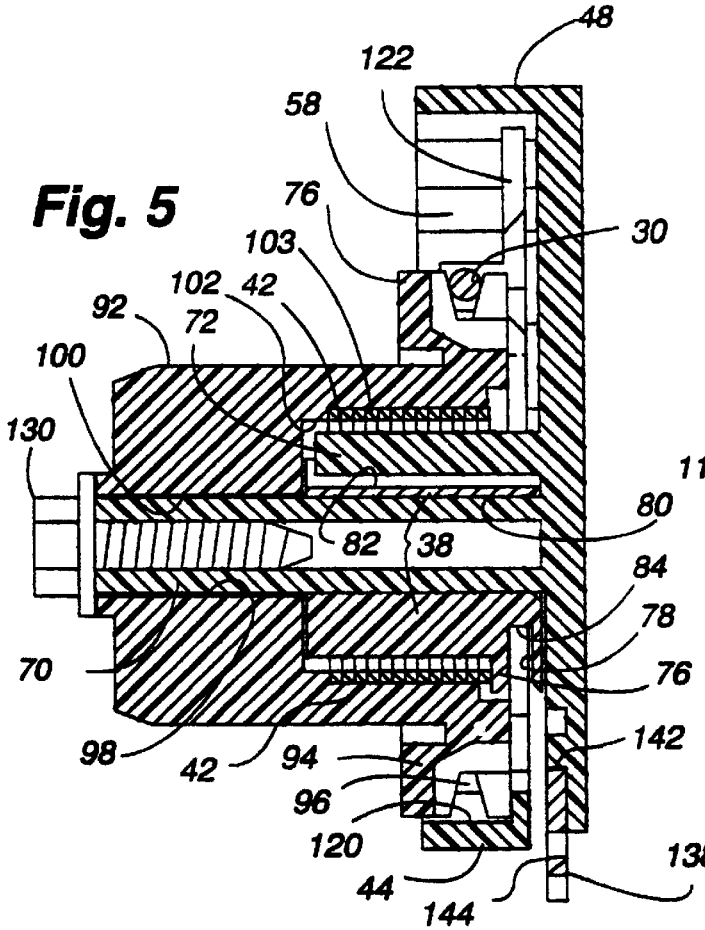
FIG. 5 is an enlarged section taken along line 5—5 of FIG. 2.
Figure 7:
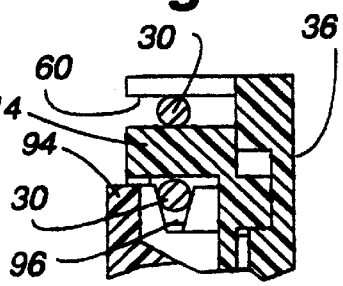
FIG. 7 is a fragmentary section showing a side portion of the headrail incorporating the present invention wherein the locked plate that prevents release of the operating cord has been removed.
Figure 6:
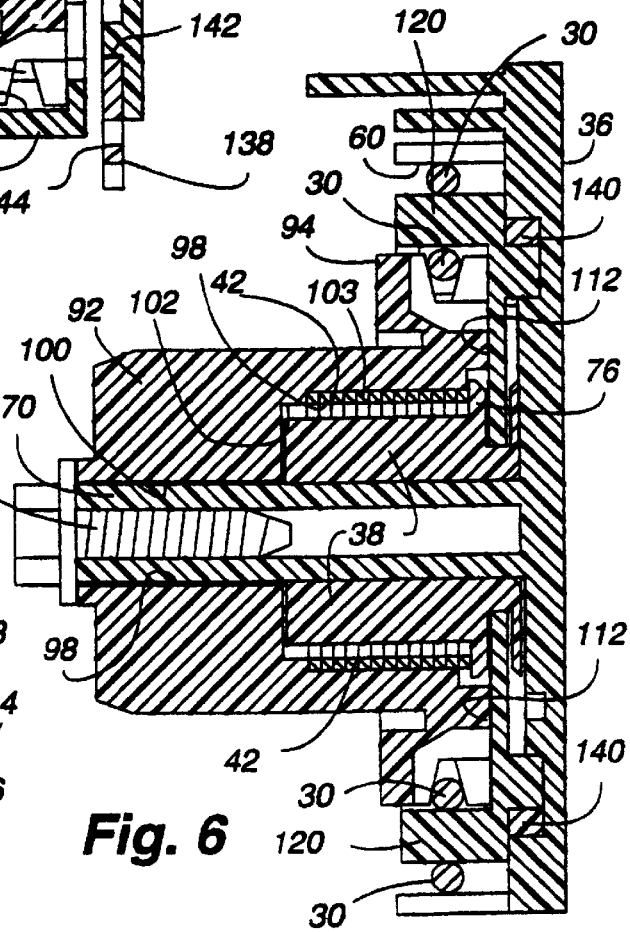
FIG. 6 is an enlarged section taken along line 6—6 of FIG. 2.

The operating cord 30 is next mounted on the mounting plate 44 so that the cord passes over the pulleys 118 and within the channels defined in the blocks 114 on the support plate. The cord is allowed to droop between the blocks 114 so that the cord lies in substantial conformance with the semi-circular cord guide plate 120. The support plate is then connected to the mounting hub 38 by advancing the support plate upwardly with the clamp arms 112 being guided within the annular groove 78 until the support plate is snapped onto the mounting hub within the annular groove 78 and for reasons described previously, the support plate is then keyed to the mounting hub for unitary pivotal movement therewith. It will also be appreciated that the drive wheel 40, as best seen in FIGS. 5 and 6, is aligned with the cord guide plate 120 so that the operating cord is confined between the guide plate and the teeth of the drive wheel so as to remain in engagement with the teeth which grip the cord allowing the cord to rotate the wheel under predetermined conditions by applying axial pulling forces to one portion or the other of the cord as it depends from opposite sides of the drive wheel. It will also be appreciated that the guide plate when connected to the mounting hub pivots with the hub about the longitudinal axis of the hub, with this pivotal movement being illustrated best in FIGS. 10 through 12.

Figure 10:
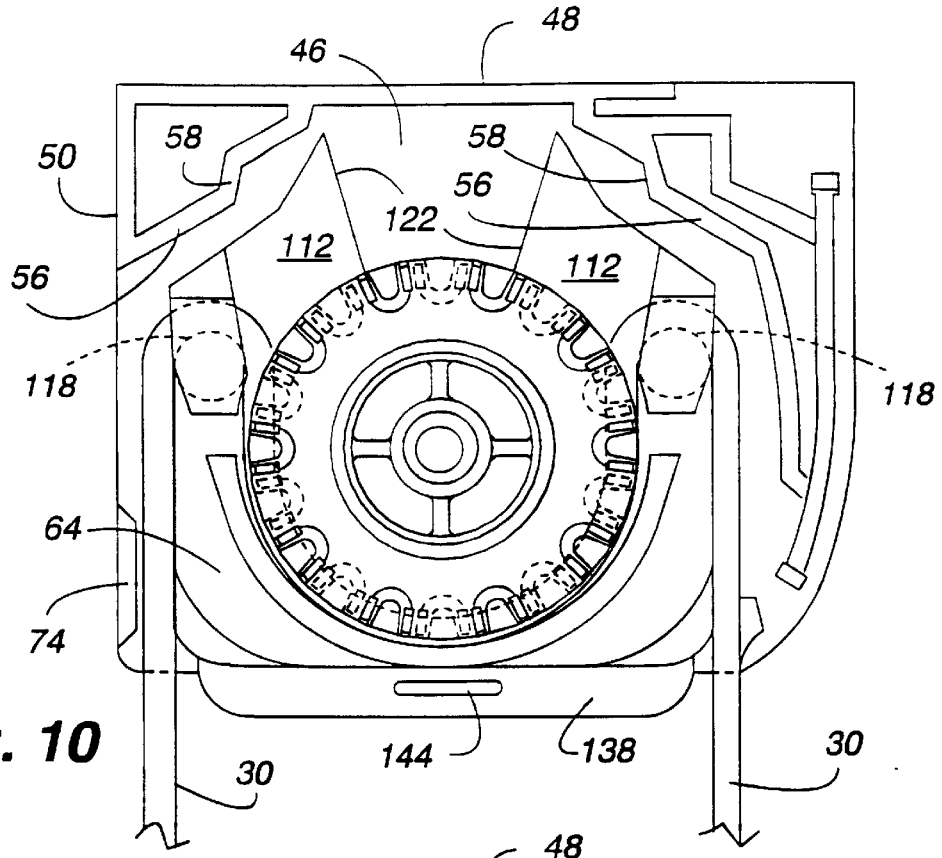
FIG. 10 is an axial view from the left of the assembly as illustrated in FIG. 5, with the mounting plate being in a centered or neutral position.
Figure 11:
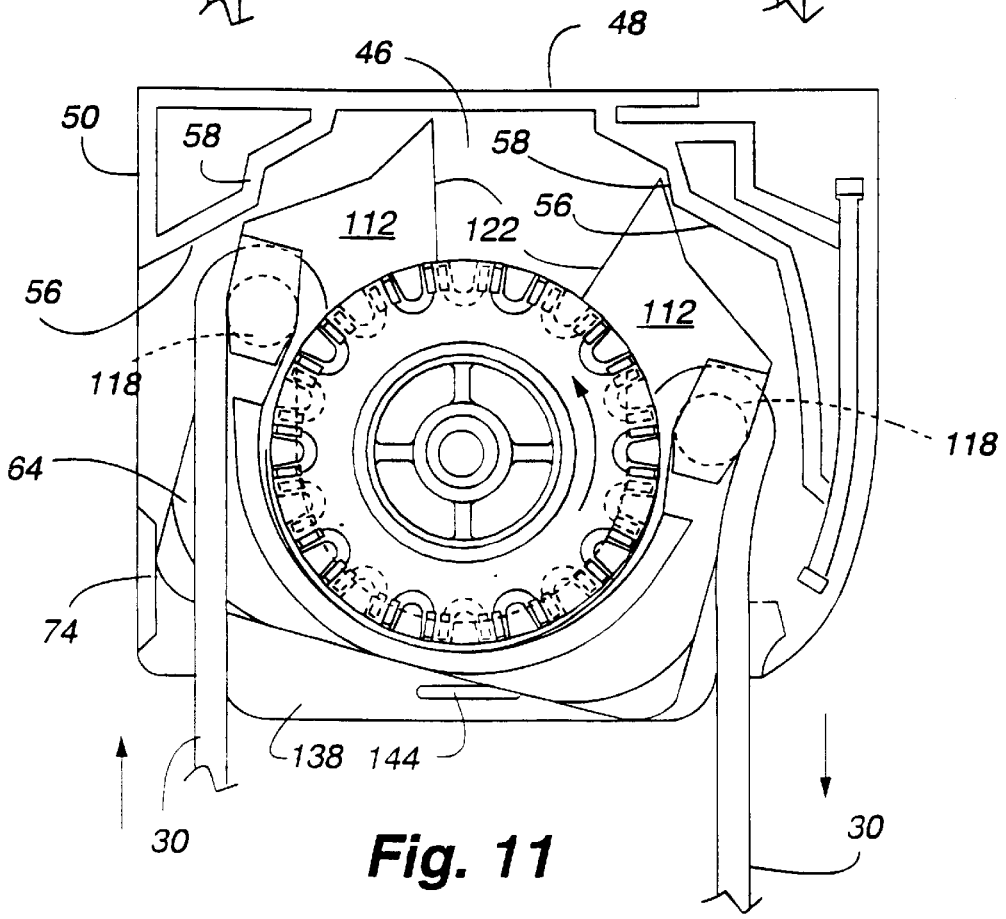
FIG. 11 is a view similar to FIG. 10, with the right-hand portion of the operating cord having been axially pulled to tilt the mounting plate to the right.
Figure 12:
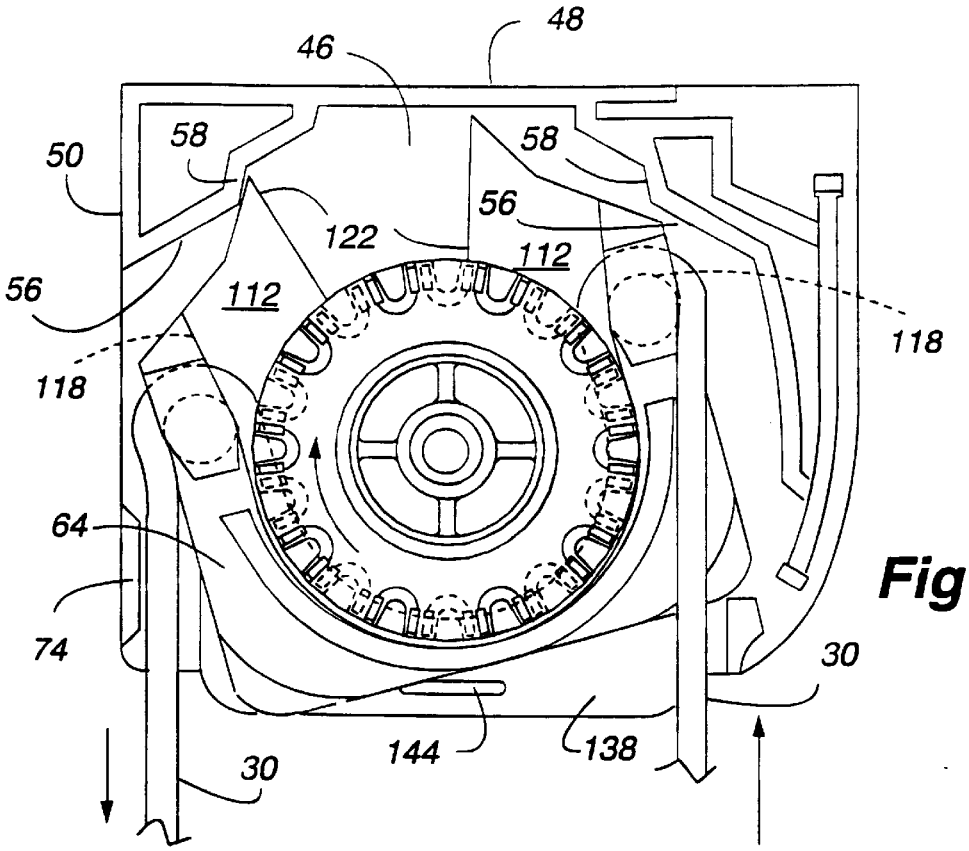
FIG. 12 is a view similar to FIG. 11 showing the mounting plate tilted to the left as by an axial pulling force to the left side portion of the operating cord.

In FIG. 10, the mounting plate 44 is shown vertically oriented in a centered position with the top edge of the clamp arms 112 being disposed adjacent to the downwardly divergent zig zag projections 56 on the base of the mounting support. If the right-hand portion of the operating cord, as viewed in FIGS. 10 through 12, has an axial pulling force applied thereto, as shown in FIG. 11, the mounting plate 44 will be caused to pivot in a clockwise direction until the right clamp arm engages the abutment surface 58 on the associated zig zag projection. The abutment of the clamp arm with the zig zag projection, obviously, limits pivotal movement of the mounting plate and also the connected mounting hub. As the hub pivots in a clockwise direction, the left side wall of the U-shaped channel 82 formed in the mounting hub, as seen in FIG. 13, engages associated tabs 106 of the coil springs moving the tabs in a clockwise direction reducing the effective diameter of the coil springs and their engagement with the drive member 90 allowing the drive member to rotate in a counterclockwise direction, as is well known with spring clutches. Of course, pivotal movement of the mounting plate 44 in a counterclockwise direction, as viewed in FIG. 12, which results when the left side portion of the operating cord has an axial pulling force applied thereto, causes the reverse action so that the right side wall of the U-shaped channel 82 engages the other set of associated tabs on the coil springs reducing the effective diameter of the spring and allowing the drive member to rotate in a clockwise direction.

As will be appreciated, the pivoting or tilting movement of the mounting plate 44 is used to activate or deactivate the clutch system so that the drive member 90 can only be rotated upon a tilting or pivoting movement of the mounting plate which results from an axial pulling force on one portion of the operating cord or the other. Obviously, when neither operating cord portion is being pulled, the coil springs cause the mounting plate to be centered thereby deactivating the clutch and locking the drive member to the mounting hub so that the drive member is prevented from rotation. Accordingly, the drive member can only rotate when only one portion of the operating cord has an axial pulling force applied thereto.

It is important to appreciate that the pulleys 118 around which the operating cord 30 extends are disposed at an elevated position relative to the pivot axis of the mounting plate which is the longitudinal axis of the mounting hub 38, as best seen in FIG. 10. It will therefore be appreciated that when the pulleys are moved downwardly by axial pulling forces on the operating cord, the horizontal displacement between the pivot axis and the pulleys increases. Oppositely, as a pulley is elevated relative to the pivot axis upon pivotal movement of the mounting plate, the horizontal distance between the pivot shaft and the pulley decreases. Accordingly, when the mounting plate is pivoted in one direction or the other, one pulley becomes horizontally displaced further from the pivot axis while the other pulley becomes less displaced so that the clamp arms remain equally spaced and in positive engagement with the mounting hub for unitary pivotal movement therewith.

It will be appreciated, however, if both portions of the operating cord 30 have axial pulling forces applied thereto at the same time and of substantially the same magnitude, both pulleys 118 will be pulled downwardly at the same time causing each to be displaced a greater horizontal distance from the pivot axis. This displacement forces the clamp arms 112 to flex away from each other until the gap between the clamp arms is greater than the diameter of the inner surface 84 of the annular groove 78 in which they are disposed. The mounting plate 44 can thereby be pulled downwardly, along with the operating cord, and completely released from the remainder of the system. Such a simultaneous uniform pulling force applied to the depending portions of the operating cord is of the type which would be automatically applied to the operating cord if a child's or infant's head were disposed between the operating cord portions and moved downwardly by gravity as shown in FIG. 1 against the lowermost extent of the operating cord. In the event of such an occurrence, the operating cord is automatically released from the remainder of the retractable covering so as not to injure the child or infant.

In the event the owner or operator of the retractable covering did not desire such a releasable system, provision has been made for negating or deactivating the release of the mounting plate 44 from the remainder of the system. With reference to FIGS. 9A and 9B, it will be appreciated that the outer face of the mounting plate 44 has a pair of arcuate ribs 132 formed thereon with these ribs being adapted to ride and pivot within the U-shaped groove 64 formed in the inner face of the mounting support 36. The arcuate ribs 132 are adapted to be disposed adjacent to the innermost surfaces 134 (FIG. 8) of the vertical legs of the U-shaped groove 64 when the support plate is in its neutral position of FIG. 10. A gap between the arcuate ribs and the outer edges 136 (FIG. 8) of the vertical legs 64' of the U-shaped groove exists, with this gap being necessary to allow the mounting plate to pivot relative to the mounting support in normal operation of the break away operating cord system.

A lock plate 138, as seen in FIGS. 4, 9A, and 9B, is adapted to cooperate with the mounting plate and the mounting support to prevent release of the mounting plate from the mounting support. As will be appreciated, the lock plate is of generally U-shaped configuration defining a pair of relatively thin upstanding legs 140. The lock plate is adapted to be inserted into the U-shaped groove 64 of the mounting support so that the upstanding legs 140 on the lock plate fit within the gap defined between the arcuate ribs 132 and the outer edges 136 of the U-shaped groove. When the lock plate is in this position, there is still enough freedom of movement of the arcuate ribs to permit the support plate to pivot enough to operate the clutch system, but the clamp arms cannot be simultaneously separated far enough to release the support plate from the mounting hub. The lock plate has a guide groove 142 formed therein adapted to cooperate with the guide pin 68 on the mounting support so as to properly position and retain the lock plate when used. The lock plate also has a small elongated slot 144 formed therethrough of a size adapted to receive the head of a screwdriver or the like so that the lock plate can be easily removed from the mounting support to allow the release feature of the system to be operative.

It will be appreciated that the aforedescribed break away operating cord system will very dependably avoid injury to a child or infant whose head is caught within the closed end of an operating cord, as uniform pulling forces are naturally applied in such an instance to both depending portions of the cord causing a quick and automatic release of the support plate and thus the attached operating cord from the remainder of the retractable covering. The system is also designed to be cooperative with the clutch system typically found in control systems for retractable coverings so that the rotating control rod, tilt rod or roll bar, whichever the case may be, is restricted from rotative movement unless it is desired to rotate the control rod or the like in one rotative direction or the other.

Although the present invention has been described with a certain degree of particularity, it is understood that the present disclosure has been made by way of example, and changes in detail or structure may be made without departing from the spirit of the invention as defined in the appended claims.

What is claimed is:

1. A break away operating cord system and retractable covering combination for an architectural opening, said combination including:

a retractable barrier adapted to extend across the architectural opening and said operating cord system for manipulating the barrier through rotation of a support element in the operating cord system on which the barrier is mounted, said operating cord system comprising in combination:

a drive member operatively connected to said support element for unitary rotation therewith, an operating cord operatively and selectively engageable with said drive member to reversibly rotate said drive member, said operating cord having first and second portions depending from opposite sides of said drive member such that an axial force on said first portion causes rotation of said drive member in a first direction and an axial force on said second portion causes rotation of said drive member in an opposite direction, a mounting plate having releasable elements supporting said operating cord for selective operative engagement with said drive member; and a mounting support for said mounting plate, said mounting support releasably supporting said mounting plate such that substantially equal axial forces applied simultaneously to said first and second portions of said operating cord causes said releasable elements on said mounting plate to be released from said mounting support thereby separating said mounting plate and operating cord from the remainder of said cord operated system and the retractable covering.

2. A break away cord system and retractable covering combination for an architectural opening, said covering including a retractable barrier mounted on a rotatable member, said barrier adapted to extend across the architectural opening, and said cord system being adapted for manipulating the barrier through rotation of said rotatable member which forms part of said cord system, said combination comprising:

an operating cord operatively and selectively engageable with said rotatable member to reversibly rotate said rotatable member, said operating cord having first and second portions depending from opposite sides of said rotatable member such that an axial pulling force on said first portion causes said rotatable member to rotate in a first direction and an axial pulling force on said second portion causes said rotatable member to rotate in an opposite direction, and a reasonable release system supporting said operating cord such that simultaneous axial pulling forced applied to said first and second portions selectively disengages said operating cord from operative engagement with said rotatable member and separates said operating cord from said rotatable member and barrier.

3. The system of claim 2 wherein said release system includes a mounting plate supporting said operating cord for selective operative engagement with said rotating member and a mounting support releasably supporting said mounting plate.

4. The system of claim 1 wherein said mounting plate is pivotally and releasably supported on said mounting support.

5. The system of claim 4 wherein said mounting plate includes a pair of flexible clamp arms yieldingly biased into a clamping position in which position the clamp arms releasably retain the mounting plate on the mounting support.

6. The system of claim 5 wherein said mounting support includes abutments to substantially prevent flexing of said clamp arms upon either an axial pulling force on said first portion of the operating cord or an axial pulling force on the second portion of said operating cord but not upon substantially equal and simultaneous axial pulling forces on both said first and second portions of the operating cord.

7. The system of claim 4 wherein axial pulling forces on said first and second portions of the operating cord cause the mounting plate to pivot relative to the mounting support.

8. The system of claim 6 wherein said abutments limit the pivotal movement of said mounting plate.

9. The system of claim 5 further including a removable lock plate releasably mountable on said mounting support in a position to limit flexing of said clamp arms to prevent a release of said mounting plate from said mounting support.

10. The system of claim 1 further including a clutch system operatively connected to said drive member to selectively prevent rotation of said drive member.

11. The system of claim 10 wherein said clutch system is selectively engageable and disengageable such that when the clutch system is disengaged the drive member is prevented from rotating and when the clutch system is engaged the drive member is reversibly rotatable by axial pulling force on one or the other, but not both simultaneously, of the first and second operating cord portions.

12. The system of claim 11 wherein said mounting plate is reversibly pivotable by axial pulling forces on one or the other of said first and second operating cord portions and pivotal movement of said mounting plate engages said clutch system.

13. The system of claim 12 wherein pivotable movement of the mounting plate in a first direction engages the clutch system to allow the drive member to rotate only in a first direction and pivotal movement of the mounting plate in an opposite direction engages the clutch system to allow the drive member to rotate only in an opposite direction.

14. The system of claim 13 wherein said clutch system includes a coil spring frictionally engaged with said drive member when the coil spring is in an at rest position and the clutch system is disengaged, said coil spring being substantially fixed in position to prevent rotation of the drive member when the clutch is disengaged.

15. The system of claim 14 wherein said coil spring has engagement means which can be manipulated to change the diameter of the coil spring to permit rotation of the drive member relative to the coil spring.

16. The system of claim 15 wherein said engagement means are selectively engageable upon pivotal movement of said mounting plate.

17. The system of claim 16 further including a mounting hub pivotally mounted on said mounting support and releasably connected to said mounting plate for unitary pivotal movement therewith.

18. The system of claim 17 wherein said mounting hub is selectively engageable with said engagement means on said coil spring upon pivotal movement of said mounting plate.

19. The system of claim 18 further including a stop member on said mounting support cooperating with said mounting hub to permit pivotal movement of the mounting hub while prohibiting rotational movement of the mounting hub.

20. The system of claim 19 wherein said mounting plate includes a pair of flexible clamp arms yieldingly biased into a clamping position in which position the clamp arms releasably connect the mounting plate to the mounting hub.

21. The system of claim 20 wherein said mounting support includes abutments to substantially prevent flexing of said clamp arms upon either an axial pulling force on said first portion of the operating cord or an axial pulling force on the second portion of the operating cord but not upon substantially equal and simultaneous axial pulling forces on both said first and second portions of the operating cord.

22. The system of claim 21 further including a removable lock plate releasably mounted on said mounting support in a position to limit flexing of said clamp arms to prevent a release of said mounting plate from said mounting support.

23. An operating system for a covering for an architectural opening comprising:

an operating mechanism adapted to be operatively coupled to said covering for controlling movement of said covering across said architectural opening; and an operating loop cord coupled to said operating mechanism for controlling the movement of said operating mechanism, said operating loop cord being mounted on a member that is separable from said operating mechanism and said covering when a predetermined force is applied to said operating loop cord.

24. The operating system of claim 23 wherein said operating mechanism controls the lifting and lowering of said covering.

25. The operating system of claim 23 wherein said covering is a window covering.

26. The operating system of claim 25 wherein said window covering has slats that are horizontally disposed and that are able to rotate.

27. The operating system of claim 25 wherein said operating mechanism controls the raising and lowering of said window covering.

28. The operating system of claim 26 wherein said operating mechanism controls the rotation of said horizontally disposed slats.

29. The operating system of claim 25 wherein said operating mechanism moves the window covering across the window.

30. The operating system of claim 23 wherein said operating loop cord has two cord portions hanging vertically from said operating mechanism and said operating loop cord is separable from said operating mechanism when a substantially equal predetermined force is applied to both cord portions simultaneously.

31. A method of separating and reattaching an operating loop cord coupled to a covering assembly of an architectural opening comprising the steps of:

providing a force release mechanism for coupling said operating loop cord to said covering assembly, applying a predetermined force to said operating loop cord to release said cord from the covering assembly; and, reattaching the force release mechanism to the covering assembly.

32. The method of claim 31 wherein said operating loop cord defines a lowermost extent and said force is applied to the lowermost extent of said operating loop cord.

33. Cord operating system for rotatably controlling movement of an architectural covering device, said operating system including:

a looped endless operating cord for manipulation by hand, said operating cord being arranged to define first and second depending portions substantially parallel to one another and upper and lower closed ends connecting the first and second depending portions;

a rotatable drive member for transmitting rotation for controlling the covering device, said rotatable drive member having a circumferential drive surface;

a mounting support adapted to be fixed in relation to the covering device, said mounting support rotatably supporting the rotatable drive member;

a release plate being movably arranged on said mounting support;

yieldable connecting means for releasably connecting said release plate to said mounting support; and guide means on said release plate for guiding the upper closed end of said operating cord in driving engagement with a portion of the drive surface of the rotatable drive member to selectively and reversibly rotate the rotatable drive member; wherein said first and second depending portions of the operating cord depend from opposite sides of said release plate at diametrically opposite positions with respect to the rotatable drive member, such that an axial pulling force on either one of the first and second portions causes the rotatable drive member to rotate in either of a first and second rotational sense, while substantially equal pulling forces of predetermined magnitude applied simultaneously in an axial direction to the first and second portions cause the yieldable connecting means to allow the release plate to release from the mounting plate and to disengage the looped operating cord from the rotatable drive member and thereby to separate the operating cord from the mounting support.

34. Cord operating system according to claim 33, wherein said release plate is pivotally supported on the mounting support, having a pivot axis coextensive with said rotatable drive member.

35. Cord operating system according to claim 33 wherein the yieldable connecting means comprises a pair of flexible arms on said release plate, said flexible arms being yieldingly biased to retain the release plate on the mounting support.

36. Cord operating system according to claim 33, wherein said release plate is pivotally supported on the mounting support, having a pivot axis coextensive with said rotatable drive member and wherein the yieldable connecting means comprises a pair of flexible arms on said release plate, said flexible arms being yieldingly biased to retain the release plate on the mounting support.

37. Cord operating system according to claim 36, wherein said mounting support includes at least one abutment to substantially prevent flexing of said flexible arms when the operating cord is subjected to only an axial pulling force on one of its first and second portions and said release plate is thereby caused to pivot relative to the mounting support against said at least one abutment.

38. Cord operating system according to claim 37, wherein said release plate is reversibly pivotable in either one of a first and a second direction upon an axial pulling force on one or the other of said first and second portions of said operating cord and pivotal movement of said release plate prevents flexing of said flexible arms in at least one of said first and second directions by abutting said at least one abutment.

39. Cord operating system according to claim 34, wherein said mounting support comprises a support shaft and said rotatable drive member comprises a mounting hub having a central cylindrical passage engaged on said support shaft.

40. Cord operating system according to claim 36, wherein said mounting support comprises a support shaft and said rotatable drive member comprises a mounting hub having a central cylindrical passage engaged on said support shaft.

41. Cord operating system according to claim 40 wherein said mounting hub comprises a contoured annular groove and said release plate comprises correspondingly contoured inner edges on said flexible arms to yieldingly fit in said contoured annular groove.

42. Cord operating system according to claim 41 wherein said contoured annular groove comprises a semi-circular lower half inner surface terminating in upper inwardly directed shoulders and each of said contoured inner edges of said flexible arms comprising a complementary lower arcuate segment terminating in an upper horizontal lip.

43. Cord operating system according to claim 33, 34, or 35, wherein said guide means comprises a semi-circular guide surface projecting from said release plate to extend in close circumferential relationship with a portion of the cylindrical drive surface and between a pair of opposite return pulleys on said release plate at diametrically opposite positions with respect to the rotatable drive member.

* * * * *

UNITED STATES PATENT AND TRADEMARK OFFICE

CERTIFICATE OF CORRECTION

PATENT NO. : 6,116,325
DATED : September 12, 2000
INVENTOR(S) : Colson et al.

It is certified that error appears in the above-identified patent and that said Letters Patent is hereby corrected as shown below:

Column 11,
Line 14, delete "resonable" and insert -- reusable --.

Signed and Sealed this

Twenty-sixth Day of February, 2002

*Attest:*

*Attesting Officer*

JAMES E. ROGAN
*Director of the United States Patent and Trademark Office*